US005603402A

United States Patent [19]

Cuneo

[11] Patent Number: 5,603,402

[45] Date of Patent: Feb. 18, 1997

[54] CONTAINER FOR HYDROCLEANING APPARATUSES

[75] Inventor: Carlo A. Cuneo, Crema, Italy

[73] Assignee: Faip S.r.l. Officini Meccaniche, Vaiano Cremasco, Italy

[21] Appl. No.: 534,475

[22] Filed: Sep. 27, 1995

[30] Foreign Application Priority Data

May 3, 1995 [IT] Italy ..... MI9500299 U

[51] Int. Cl.[6] ..... B65D 25/28; B65D 43/16

[52] U.S. Cl. ..... 206/320; 206/576; 220/324; 220/339; 220/756; 220/771

[58] Field of Search ..... 206/305, 320, 206/373, 576; 220/324, 337, 339, 755, 756, 768–771

[56] References Cited

U.S. PATENT DOCUMENTS

| | | | |
|---|---|---|---|
| 2,226,670 | 12/1940 | Pratt et al. | 206/511 |
| 3,305,076 | 2/1967 | Fleenor | 220/771 |
| 3,334,714 | 8/1967 | Gordon | 220/771 |
| 3,546,752 | 12/1970 | Sargent | 220/324 |
| 4,164,309 | 8/1979 | Staats | 220/771 |
| 4,522,312 | 6/1985 | Rathgeber et al. | 220/324 |
| 4,773,536 | 9/1988 | Rau | 220/771 |
| 4,792,055 | 12/1988 | Schupack et al. | 220/771 |
| 4,974,740 | 12/1990 | Niles | 220/324 |
| 5,040,834 | 8/1991 | Kahl et al. | 220/324 |

FOREIGN PATENT DOCUMENTS

| | | | |
|---|---|---|---|
| 2222144 | 2/1990 | United Kingdom | 220/771 |

*Primary Examiner*—Jimmy G. Foster
*Attorney, Agent, or Firm*—Bucknam and Archer

[57] ABSTRACT

Container for hydrocleaning apparatuses, in particular compact hydrocleaning machines (16), comprising a couple of opposed and identical half-shells (12,14) hingen to one another on a first side (56) and provided each on a second side (30), opposite to the hinged one, with a central recess (30') circumscribing a through-opening (32) extended transversally; said opening (32) being surmounted by a portion of said second side (30) adjoining edge (40), which develops in the lower part in a sector (34) constituting a half-part of the handle. The configuration and the depth of recess (30') are complementary to the sinking formed on the upper front of the hydrocleaning machines (16).

9 Claims, 5 Drawing Sheets

CONTAINER FOR HYDROCLEANING APPARATUSES

BACKGROUND OF THE INVENTION

1. Field of the Invention

This invention relates to a container for hydrocleaning apparatuses, in particular for compact hydrocleaning machines.

The container of this invention constitutes the protective envelope for said apparatuses, and can be used initially during the packaging and transport stage and afterwards for the compact and easy repositioning of the same by the user following each utilization.

2. Description of Prior Art

As is known, to carry on some cleaning operations, specific apparatuses are sometimes used which are called hydrocleaning machines, and which allow to realize and orient a high pressure water jet on the surfaces to be cleaned. Besides the machines used by industries and professionals, compact hydrocleaning machines are widespreading which are used, for instance for homes and as a hobby, whose sizes and weight are limited. This type of machines, like those of a higher power, comprises a plurality of components and accessories which must be suitably grouped to allow an optimum packaging, storing and transport of the whole. This need is particularly felt by the producers of the concerned machines, which prepare for this purpose cardboard containers with internal shells from expanded polystyrene, provided with seats for housing the various components and accessories. The package must have a regular conformation, generally parallelepipedal, to allow the superposition of several packings and the related palletization for the storing and transport of the machines.

This solution is not free from severe drawbacks and is especially unpractical for the final user. The use of cardboard containers and the related polystyrene shells cause space problems in correspondence of the packing lines, besides requiring long packaging times. Besides, the final user is not provided with a container suitable to be systematically re-utilized to put away the apparatus once it has been used, because of the liability to deterioration of cardboard and polystyrene. The traditional containers which integrate the apparatus are not easily handled, being generally devoided of a handle such as to allow, especially in relation with the needs of the final user, to transfer the whole from a place to another one.

SUMMARY OF THE INVENTION

The object of this invention is to obviate the aforementioned drawbacks.

More particularly, the object of this invention is to provide a container for hydrocleaning apparatuses, suitable to constitute a simple and strong packaging for the storing and transport of the cleaning machines, in particular, for compact hydrocleaning machines.

A further object of this invention is to provide a container systematically re-utillizable by the final user, without envelope deterioration problems.

A not least object of this invention is to provide a container suitable to be easily handled or transported both in the production factory and by the final user.

A further object of this invention is to provide a container suitable to be easily palletizable and kept in a precise position during storing and transport.

Still a further object of this invention is to provide a container suitable to ensure a high level of resistance and reliability in the long run, and besides such as to be easily and economically realizable.

According to this invention, these and still other objects are achieved by a container suitable for compact hydrocleaning apparatuses, in particular compact hydrocleaning machines, obtained from plastic material or other suitable material, comprising a couple of opposed and identical half-shells provided, on the upper front, with a central recess circumscribing a transversally extended through-opening, surmounted by a portion of said front, adjoining the edge, which develops in the lower part in a sector constituting a half-part of the handle of said container.

DESCRIPTION OF THE DRAWINGS

The constructive and functional characteristics of the container for hydrocleaning apparatuses subject matter of this invention will be made clearer by the following detailed description wherein reference is made to the attached drawings which represent a preferred embodiment shown by way of example, and wherein.

DESCRIPTION OF THE PREFERRED EMBODIMENT

Figure 1:
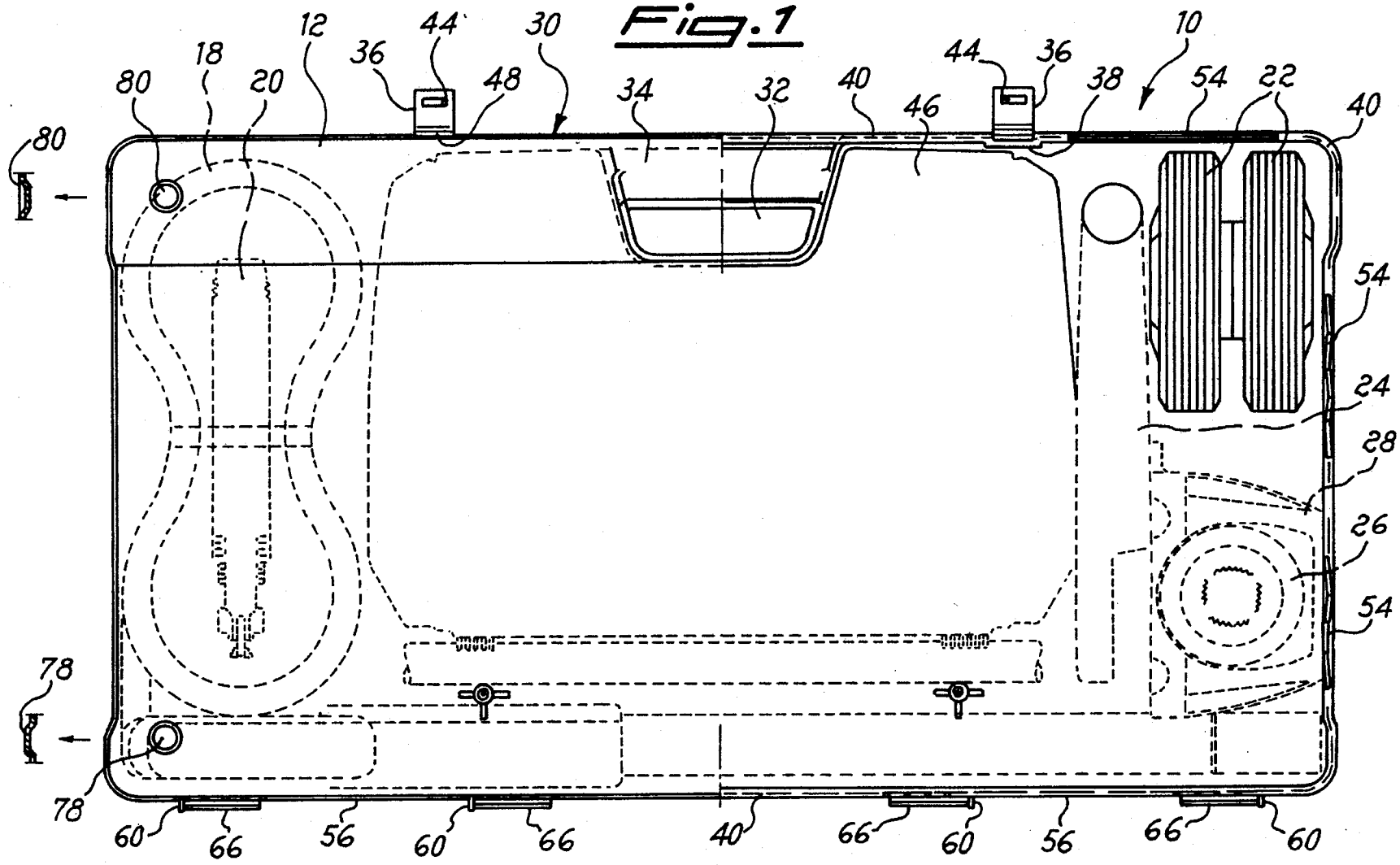
FIG. 1 shows a schematic front view of the container of this invention, where the components of the hydrocleaning apparatus are indicated by broken lines.
Figure 2:
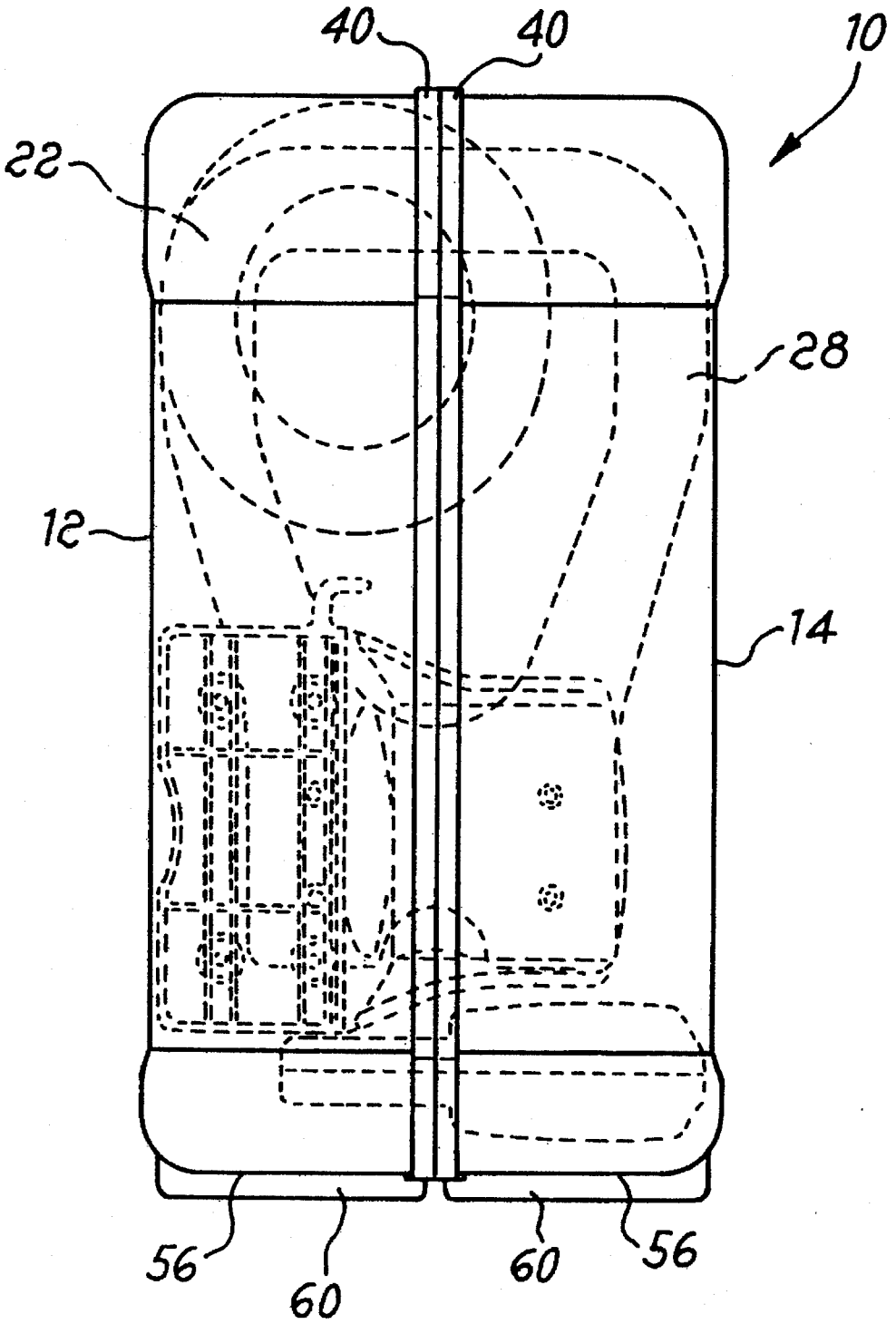
FIG. 2 shows a schematic side view of the container of FIG. 1.

With reference to the aforementioned drawings, the container for hydrocleaning apparatuses subject matter of this invention, indicated on the whole by 10, is constituted by a suitcase-shaped envelope comprising two opposite half-shells 12,14, preferably from plastic material, such as for instance polypropylene. Each of said half-shells has preferably a substantially rectangular plan and circumscribes in its inside the seat housing a plurality of components and accessories—indicated by broken lines—which form a compact hydrocleaning machine of a known type.

By way of non limitative example, said components and accessories include the machine body 16, the coil of feed wires 18 and/or the flexible pipe for the fluid, the distribution nozzle 20 and the wheels 22 applicable to said machine. The references 24, 26 and 28 concern respectively the rigid ducts or pipes for the fluid and handles applicable to the machine.

Each of the half-shells 12,14 which form container 10 is provided, on the upper front or side 30, with a central recess 30' circumscribing a transversally extended through-opening 32. In correspondence of said recess 30', the upper front or side 30 is limited to a strip adjoining edge 40, developed in the lower part in a sector 34 constituting a half-part of the handle of container 10. Preferably, the configuration of the central recess 30' and its development in depth are complementary to the sinking formed on the upper front of the conventional hydrocleaning machine 16 for the formation of the related handling. Therefore, said recess 30' forms, inside the half-shells 12,14, a shaped extension which fixes in the centre and keeps in position the hydrocleaning machine 16 in the container of said machine. Under and sideways on machine 16 are housed the various components and accessories above defined by way of example.

Figure 4:
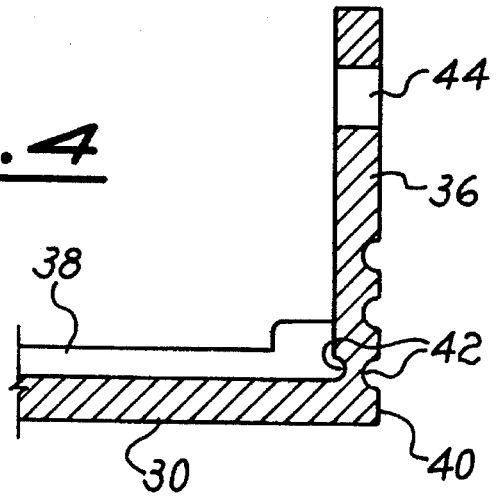
FIG. 4 shows the schematic view of a longitudinal section of one of the closing tongues of the container.
Figure 5:
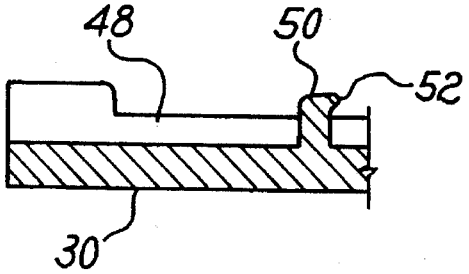
FIG. 5 shows the schematic view of a longitudinal section of one of the teeth in which the closing tongues of the container of FIG. 4 fit.
Figure 6:
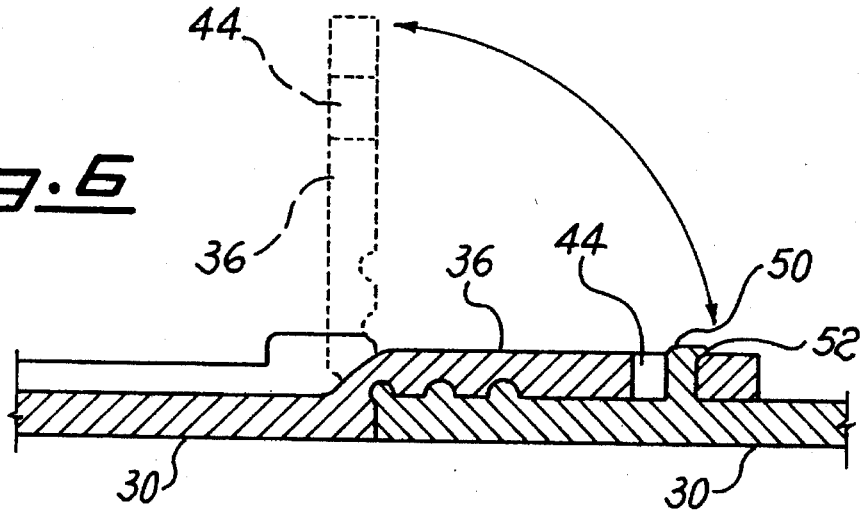
FIG. 6 shows the schematic view of a longitudinal section of one of the closing tongues of the container coupled to the relevant tooth.

Sideways on recess 30', before or beyond the same, the upper front 30 of each of the half-shells 12,14 has a flexible tongue 36, protruding from edge 40 and preferably obtained in correspondence of a slightly sunk first sector 38 of said front. Said tongue 36, shown in detail in FIGS. 4 and 6, is integral with each of the half-shells 12,14 along edge 40 of upper front 30; in correspondence of the connection point with said edge 40, tongue 36 has a thickness reduction 42 allowing its easy tilting, as will be specified in the following.

Near the front end, tongue 36 is provided with a through-opening 44, quadrangular by way of example. Opposing the sunk sector 38 of the upper front 30, before or beyond recess 30', an analogous second sunk sector 48 is obtained. At the advanced end of said sunk sector 48 an integral projection 50, with end tooth 52, is obtained. Said tooth 52 fits in the through-openings 44, constituting the hooking means for tongue 36, when said tongue 36 is tilted and caused to orient horizontally, parallelly to front 30, as shown in detail in FIG. 6.

Figure 9:
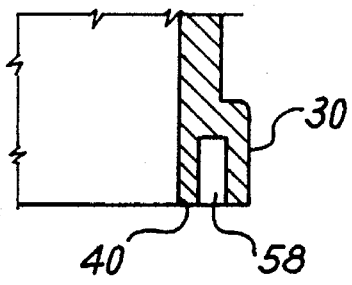
FIG. 9 shows the schematic view of one cross section of one of the seats obtained along the edge of the container for housing the beads of FIG. 8.
Figure 8:
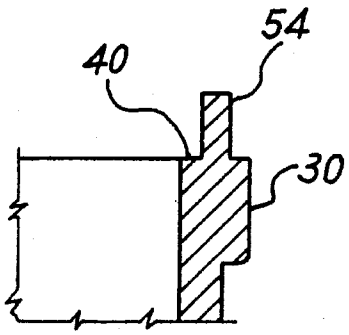
FIG. 8 shows the schematic view of a cross section of one of the beads obtained along the edge of the container.
Figure 7:
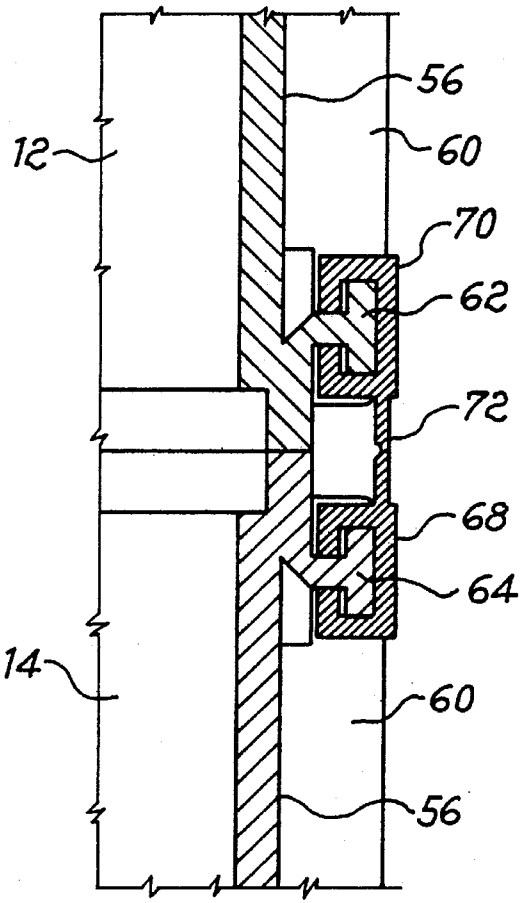
FIG. 7 shows the schematic view of a cross section of one of the hinges of the container.

Edge 40 of half-shells 12,14, frontally shown in the right part of FIG. 1, is preferably provided with a plurality of protruding beads 54, quadrangular by way of example. Said beads 54, integral with edge 40 and with each of the half-shells 12,14 are obtained along a perimetric portion of edge 40 of the same, comprised between the first sunk sector 38 of the upper front 30 and the opposite sunk front of said half-shells, indicated by 56. On the opposed edge portion 40 of each of the half-shells 12,14, in the portion comprised between the second sunk sector 48 of the upper front 30 and said opposite front 56, a plurality of recesses 58 is obtained, whose shape is complementary to that of beads 54. Said beads 54 and recesses 58 are respectively shownin detail in FIGS. 8 and 9.

On the aforementioned lower front 56 of half-shells 12,14 a plurality of protruding beads 60 is obtained, transversally extended and parallel, which circumscribe as many support zones for container 10. Said container 10 is constituted by two identical half-shells 12,14, coupled to one another by means of hinge elements, as specified in the following.

Adjoining or associated with beads 60, integrally with each of said half-shells, integral extensions 62,64 are obtained on the lower front 56, with a preferably "T"-shaped section, developed parallelly to edge 40. On said extensions 62,64 obtained respectively on half-shells 12,14, a hinge element 66 is fitted on, composed by two connected sectors 68,70, provided with a longitudinal cavity whose section is complementary to that of extensions 62,64. The central portion 72 which connects sectors 68,70 of the hinge element 66 has a centrally reduced thickness for the suitable angle orientation of said element 66 during the mutual closing approach or opening separation of the half-shells 12,14, constituting container 10.

Figure 3:
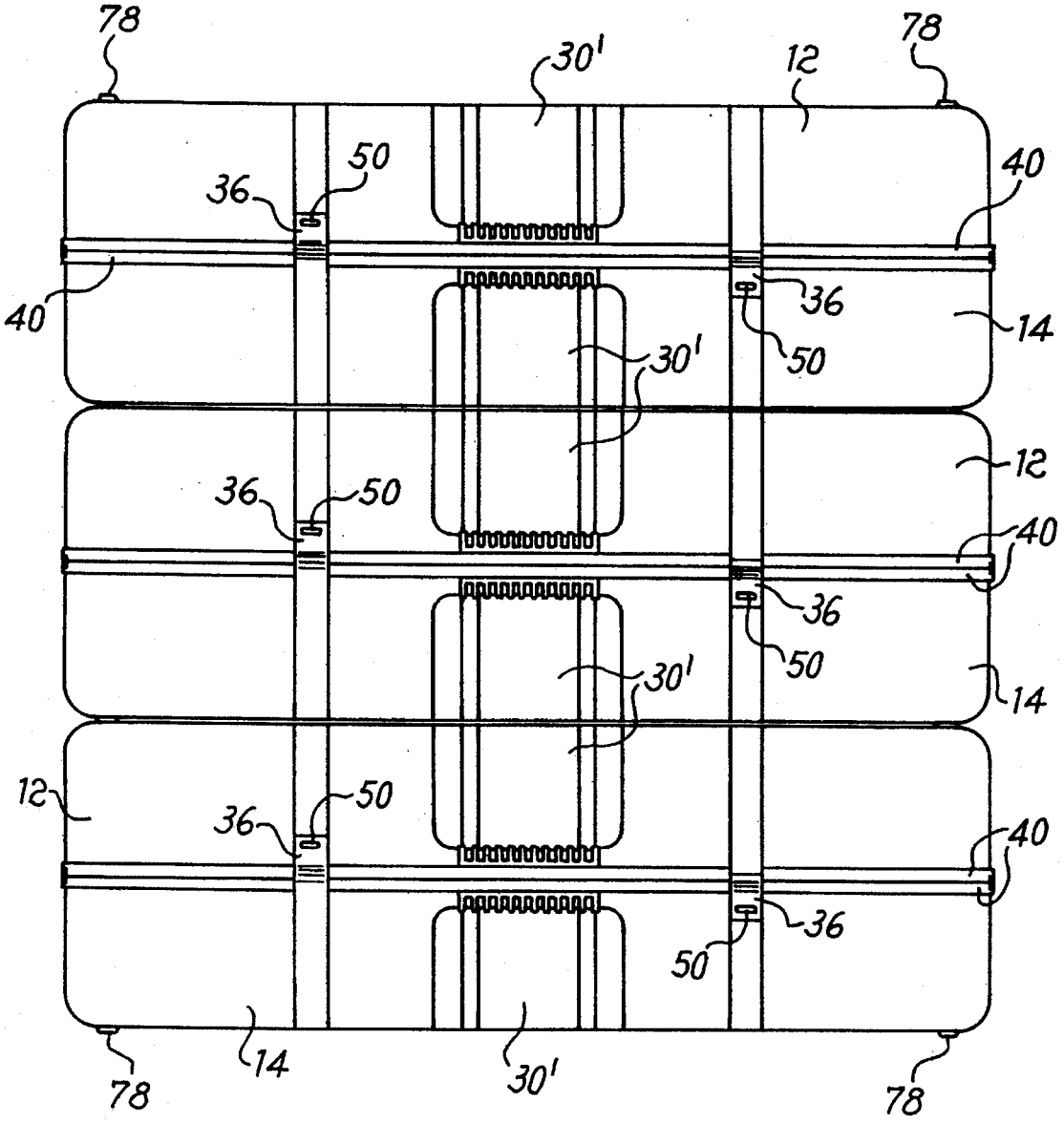
FIG. 3 is the schematic view of several stacked containers.

According to a further characteristic of the invention, on the external front of, said half-shells, preferably in correspondence of the apices, projections and complementary sunk impressions are obtained, which allow the precise restrained superposition of a plurality of containers 10, as shown in the diagram: of FIG. 3. In particular, a couple of protrusions 78, aligned and preferably of truncated-conic shape, is obtained along the lower front portion of each of the half-shells 12,14, while a couple of aligned seats 80, whose form is complementary to that of protrusions 78, is obtained on the upper front part of said half-shells 12,14. The coupling of the latter, identical and obtained from a same mould, is easily obtained by slidingly applying on extensions 62,64 the hinge elements 66. In the so formed, suitcase-container 10, the machine body and the various elements or accessories 18, 20, 22, 24, 26, 18 are then inserted. The machine body 16 is kept in the right position by the extension, formed on each half-shell 12,14, of recess 30'. The rapid coupling of said half-shells is ensured by beads 54 protruding from a part of edge 40 and the complementary recesses 58, seats of said beads, obtained along the opposite part of said edge. The closing of the two identical half-shells which form container 10 is quickly realizable thanks to tongues 36, one for each half-shell, which bend easily, coupling up, by means of their through-opening 44, tooth 52 of protrusion 50, also obtained on each of the half-shells 12,14.

Cone-shaped protrusions 78 and coupled seats 80 allow to superpose many containers 10 integrating the apparatus 16 with the related accessories, realizing the exact alignment of said containers and their self-locking.

As can be inferred from the above, the advantages achieved by the invention are evident.

The container subject matter of the invention solves to a substantial extent the known drawbacks associated to the packaging and storing of hydrocleaning apparatuses, especially compact hydrocleaning machines, is provided with a handle which allows its %easy transfer and may be advantageously re-utilized systematically by the final user.

Particularly advantageous is the fact that the forming of each half-shell constituting the container can be obtained with one only mould, as said half-shells are identical. However, the invention, as described hereabove and claimed hereafter, has only been proposed by way of example, being understood that the same is susceptible of many changes and variants, all of them falling within the innovatory concept.

For instance, the container may have an overall configuration other than the one described and illustrated by way of example; a greater or lesser number of tongues and protrusions for its closing and/or of truing beads and recesses, differently located and developed along the edge. The same recess proposed for the upper front may be differently arranged or configurated, depending on the complementary sinking existing on the body of the apparatus.

While it has been proposed in particular for hydrocleaning machines of the compact type, the container may house, with the suitable sizings, machines of a greater capacity and power, possibly of a different type.

Lastly, structure reversals or alternative locations are possible of the components or parts which form on the whole the container subject matter of this invention.

The description above has been made for illustrative purposes only, with reference to one embodiment of the present invention and is not intended to limit the scope of the invention of this application which is defined in the following claims.

I claim:

1. A container formed of plastic material for a compact hydrocleaning apparatus, said container comprising two opposed and identical half-shells (12,19) hingedly connected to one another on a first side (56), a centrally disposed recess (30') circumscribing a through opening (32) on a second side (30) opposite said first side (56), said opening (32) being surmounted on said second side (30) by an edge (40) of said container which forms a sector (34) in said recess (30') which together with said opening (32) defines a handle for said container, said recess (30') being formed to be complimentary to a sinking formed on an upper front of said compact hydrocleaning apparatus, said container further including on said first side (56) a plurality of parallel, transversely extending protruding beads (60), and pairs of T-shaped integral extensions (62, 64) arranged parallel to said edge (40), each pair of extensions being associated with a protruding bead (60).

2. The container as defined in claim 1, wherein on each pair of extensions (62, 64) a hinge element (66) is fitted comprising two connected sectors (68,70) defining a longitudinal cavity having a section complimentary to that of said extensions, and a central portion (72) of said element (66) having centrally a reduction in thickness.

3. The container as defined in claim 1, wherein each half shell further includes a flexible integral tongue (36) extending from an end of a sector (38) recessed with respect to said second side (30) at said edge (40), said tongue (36) having a through opening (44) and being displaced on said second side (30) from said recess (30'), said tongue (36) having a reduced thickness sector (42) at a point of connection with said edge (40) and extending parallel to said edge (40).

4. The container as defined in claim 3, wherein said second side (30) of each half shell is provided opposite said sector (38) with a second recessed sector (48) having a protrusion (50) extending therefrom and a tooth (52) arranged on said protrusion (50), said protrusion (50) and tooth (52) being adapted for engagement with said opening (44) of said tongue (36) when said tongue is bent at said reduced thickness sector.

5. The container as defined in claim 1, wherein said edge (40) of each half-shell (12,14) is provided, along a perimetric portion, with a plurality of protruding beads (54) and on the opposed perimetric portion of each half-shell with a plurality of corresponding and complementary recesses (58).

6. The container as defined in claim 5, wherein said protruding beads (54) and recesses (58) are disposed along edge (40) respectively in the perimetric portion comprised between one of the recessed sectors (38) or (48) of the second side (30) of the half-shells (12,14) and the first side (56).

7. The container as defined in claim 1, wherein said half-shells (12,14) include external front walls which are provided with at least two projections (78) and of complementary seats (80).

8. The container as defined in claim 7, wherein said projections (78) and said seats (80) are formed near the apices of each of the half-shells and are aligned to one another in the horizontal and vertical directions.

9. The container as defined in claim 1, wherein said half-shells (12,14) are identical and define a substantially rectangular plan configuration, so that the coupling of said half-shells has a suitcase-like configuration.

* * * * *